US006799952B2

(12) United States Patent
Urbank et al.

(10) Patent No.: US 6,799,952 B2
(45) Date of Patent: Oct. 5, 2004

(54) PNEUMATICALLY OPERATED COMPRESSOR CAPACITY CONTROL VALVE WITH DISCHARGE PRESSURE SENSOR

(75) Inventors: Thomas Martin Urbank, Lockport, NY (US); Karma Vir Sangwan, East Amherst, NY (US); Valentina A. Scarlett, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 11 days.

(21) Appl. No.: 10/235,335

(22) Filed: Sep. 5, 2002

(65) Prior Publication Data

US 2004/0047742 A1 Mar. 11, 2004

(51) Int. Cl.[7] ..... F04B 1/26

(52) U.S. Cl. ..... 417/222.2; 417/222.1; 137/454.2

(58) Field of Search ..... 417/212, 222.1, 417/222.2, 270; 137/487.5, 488, 491, 492.5, 557, 454.2, 454.4; 251/11, 12, 129.03, 129.06, 335.1, 335.3; 62/127, 228.3, 229, 230, 239

(56) References Cited

U.S. PATENT DOCUMENTS 4,050,852 A * 9/1977 Brucken et al. ..... 417/273
4,061,443 A * 12/1977 Black et al. ..... 417/222.1
5,071,321 A * 12/1991 Skinner et al. ..... 417/222.2
6,116,269 A 9/2000 Maxson ..... 137/487.5
6,179,572 B1 * 1/2001 Taguchi ..... 417/222.2
6,340,293 B1 1/2002 Bona et al.
6,361,281 B1 3/2002 Wurth et al.
6,588,222 B1 * 7/2003 Urbank et al. ..... 62/127
6,622,500 B1 * 9/2003 Archibald et al. ..... 62/173

* cited by examiner

*Primary Examiner*—Justine R. Yu
(74) *Attorney, Agent, or Firm*—Patrick M. Griffin

(57) ABSTRACT

A pneumatically-operated control valve selectively opens and closes a passage between discharge and crankcase chambers of a variable capacity refrigerant compressor for purposes of controlling the compressor capacity, and includes an integral pressure sensor for measuring the compressor discharge pressure. The valve includes a plunger having an axis, a stopper biased against a seat in the passage coupling the discharge and crankcase chambers, an annular bellows and a pressure sensor. A portion of the plunger passes through the annular bellows, and one end of the bellows is attached to the plunger for axially displacing the plunger to unseat the stopper. The stopper and plunger are maintained in engagement, and have axial bores that are aligned to form a passage between the compressor discharge chamber and a cavity in which the pressure sensor is retained.

10 Claims, 1 Drawing Sheet

PNEUMATICALLY OPERATED COMPRESSOR CAPACITY CONTROL VALVE WITH DISCHARGE PRESSURE SENSOR

FIELD OF THE INVENTION

This invention relates to a capacity control for a variable capacity refrigerant compressor, and more particularly to a pneumatically operated capacity control valve having an integral sensor for measuring the discharge pressure of the refrigerant.

BACKGROUND OF THE INVENTION

Variable capacity refrigerant compressors have been utilized in automotive air conditioning systems, with the compressor capacity being controlled by a pneumatically-operated control valve. In a typical implementation, the compressor includes one or more pistons coupled to a tiltable wobble plate or swash plate, and the control valve adjusts the pressure in a crankcase of the compressor to control the compressor capacity. In one common arrangement, for example, the compressor suction (inlet) pressure acts on a bellows to linearly position an armature in a valve passage that couples the crankcase to the compressor discharge (outlet) pressure. If the suction pressure decreases due to a reduction in the cooling load, for example, the bellows expands to open the passage, raising the crankcase pressure and decreasing the compressor capacity. When the suction pressure rises due to the decreased compressor capacity, the bellows retracts the armature to close the passage, and the compressor capacity is maintained at the reduced level. A bleed passage couples the crankcase to a suction passage so that the compressor capacity will increase if the valve passage remains closed.

Although the above-described pneumatically-operated valve can control compressor capacity in a very cost-effective manner without requiring numerous sensors for measuring various system parameters, it is still desirable to measure the compressor discharge pressure for purposes of controlling the compressor clutch and the condenser cooling fan(s). The usual approach is to mount a pressure sensor on a refrigerant line between the compressor and the expansion orifice, but variability in the position and orientation of the sensor results in variations of the sensed pressure due to transport delay and/or pooling of the refrigerant. Consistent results can only be ensured if the sensor is integrated into the compressor or control valve. Accordingly, what is needed is a pneumatically-operated capacity control valve with an integral pressure sensor for measuring the compressor discharge pressure.

SUMMARY OF THE PRESENT INVENTION

The present invention is directed to an improved pneumatically-operated control valve that selectively opens and closes a passage between discharge and crankcase chambers of a variable capacity refrigerant compressor for purposes of controlling the compressor capacity, including an integral pressure sensor for measuring the compressor discharge pressure. The valve includes a plunger having an axis, a stopper biased against a seat in the passage coupling the discharge and crankcase chambers, an annular bellows and a pressure sensor. A portion of the plunger passes through the annular bellows, and one end of the bellows is attached to the plunger for axially displacing the plunger to unseat the stopper. The stopper and plunger are maintained in engagement, and have axial bores that are aligned to form a passage between the compressor discharge chamber and a cavity in which the pressure sensor is retained. In this way, stopper can be seated or unseated to close or open the passage between the compressor discharge and crankcase chambers without interrupting the passage between the discharge chamber and the cavity in which the pressure sensor is retained.

BRIEF DESCRIPTION OF THE DRAWING

The present invention will now be described, by way of example, with reference to the accompanying cross-sectional drawing of a pneumatically operated compressor capacity control valve and pressure sensor according to this invention.

DESCRIPTION OF THE PREFERRED EMBODIMENT

Figure 1:
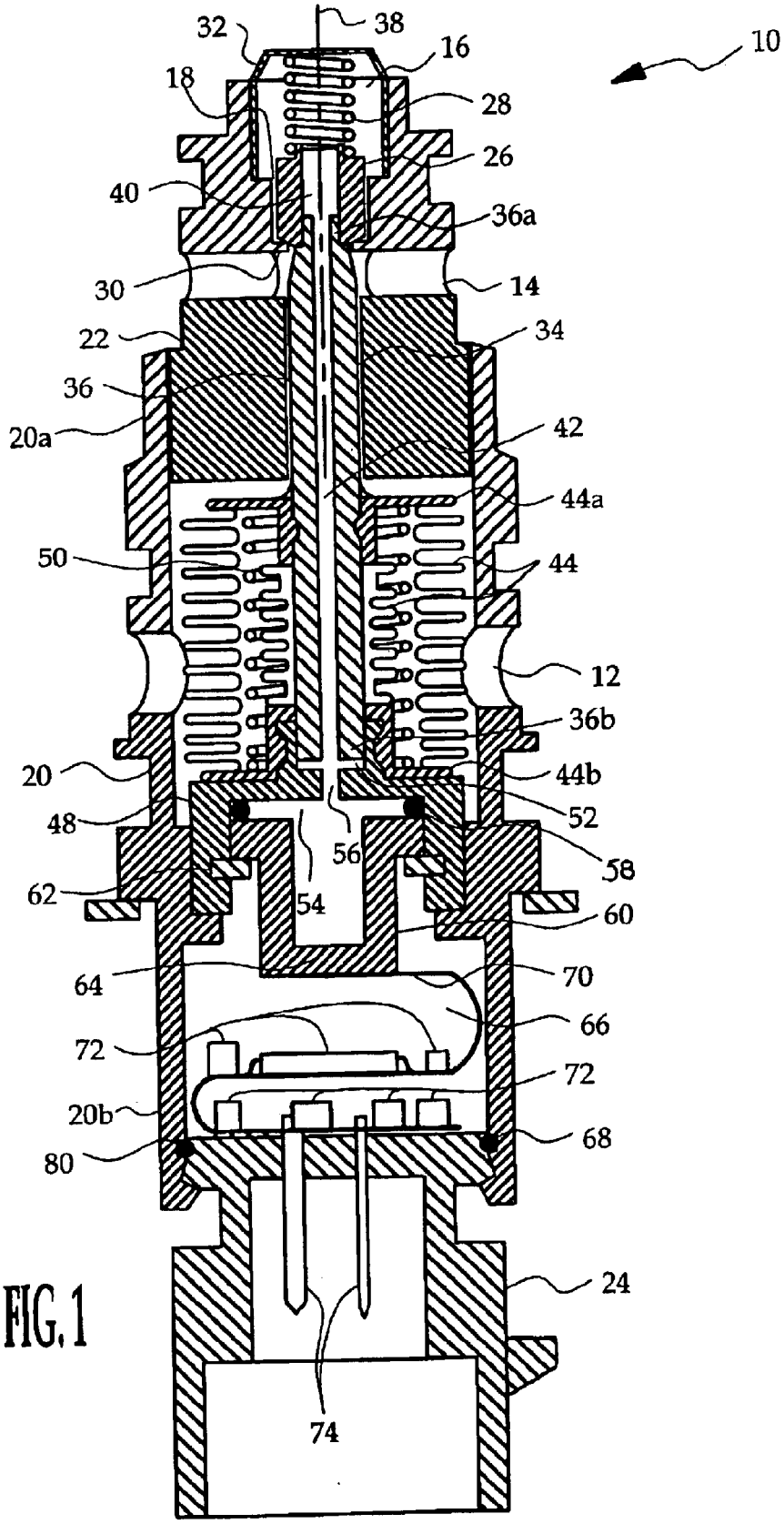

Referring to the drawing, the reference numeral 10 generally designates a capacity control valve for a variable capacity refrigerant compressor. The valve 10 is designed to be mounted in the rear-head of the compressor such that the ports 12, 14 and 16 are respectively placed in communication with chambers containing suction, crankcase and discharge pressures of the compressor. As explained below, the valve 10 operates in response to the compressor suction pressure at port 12 to selectively open a passage 18 between the crankcase and discharge ports 14 and 16 for purposes of controlling the capacity of the compressor. The ports 12, 14, 16 are formed in a valve body 20 that is closed at the inboard end 20*a* by a pressure port 22 that defines the ports 14 and 16 and the passage 18, and at the outboard end 20*b* by an electrical connector 24.

A stopper 26 disposed in the passage 18 of pressure port 22 is biased by spring 28 into engagement with a seat 30 of pressure port 22 so as to prevent refrigerant at discharge port 16 from entering the crankcase port 14. A screen 32 mounted in discharge port 16 provides a reaction surface for the spring 28 without hindering refrigerant flow through the port. The pressure port 22 also includes an axial bore 34 in which is disposed a plunger 36 having an axis 38, the plunger 36 being axially displaceable to unseat the stopper 26 against the bias force of spring 28 when communication between the ports 14 and 16 is desired. The inboard end 36*a* of plunger 36 is received within an axial bore 40 formed in the stopper 26, and the plunger 36 itself has an axial bore 42 that is axially aligned with the bore 40. The interface between the inboard end 36*a* of plunger 36 and the periphery of stopper bore 40 seals high pressure discharge refrigerant in the bores 40 and 42 from the crankcase port 14, while permitting limited relative axial displacement of the stopper 26 and plunger 36. Although stopper 26 is illustrated as being cylindrical In FIG. 1, it may alternatively be spherical.

Axial displacement of the plunger 36 is regulated by a pneumatic annular bellows 44 disposed in a portion of the valve body 20 that includes the suction port 12. The bellows include inner and outer accordion like walls, an inboard end 44*a*, and outboard end 44*b* and a spring 50. The plunger passes though the central opening of bellows 44, and the inboard end 44*a* of bellows 44 is attached (by crimping, soldering or welding, for example) to the exterior periphery of plunger 36. The outboard end 44*b* of bellows 44 is secured (by crimping, for example) to a valve body piece 48 mounted in the valve body 20 outboard of the suction port 12. Spring 50 develops a bias force tending to axially expand the bellows 44 to extend the plunger 36 but this bias force is opposed by the refrigerant suction pressure which tends to collapse the bellows 44. Accordingly, the axial length of the bellows 44, and therefore the axial position of the plunger 36, depends on the refrigerant pressure at suction port 12.

The valve body piece 48 includes an inboard cavity 52 for receiving the outboard end 36*b* of plunger 36, an outboard cavity 54, and a passage 56 connecting the cavities 52 and 54. An O-ring seal 58 and a portion of pressure sensor 60 are retained within the cavity 54 by a snap-ring 62, with the inboard end of sensor 60 compressing the O-ring seal 58. Accordingly, the inboard end of sensor 60 is in continuous communication with the discharge port 16 via the bores 40 and 42 of stopper 26 and plunger 36, a portion of the cavity 52, and the passage 56, regardless of the axial position of the plunger 36. The sensor 60 is preferably a conventional stainless steel pressure sensor having a diaphragm 64 that is subject to flexure due to the pressure differential across it. In this case, the pressure differential varies according to the refrigerant pressure in cavity 54 since the outboard end of sensor 60 is disposed in a valve chamber 66 that is sealed from environmental pressures by the O-ring 68. The mechanical strain associated with the flexure is detected by a piezo-resistor circuit (not depicted) formed on the outboard surface of sensor diaphragm 64, and a flex circuit 70 carrying various signal conditioning circuit elements 72 couples the piezo-resistor circuit to a set of terminals 74 formed in the connector 24. The signal conditioning circuit elements 72 may also be conventional in nature, and operate to convert stain-related changes in the piezo-resistor circuit into a corresponding pressure. Since the O-ring 68 seals the valve chamber 66 from environmental pressures, the detected pressure can be calibrated to indicate the absolute pressure of the refrigerant in cavity 54, as opposed to a gauge pressure that varies with ambient or barometric pressure. The O-ring 68 is retained in a valve body recess 80, and the connector 24 may be secured to the valve body 20 by swaging as indicated.

In summary, the control valve 10 operates in response to the compressor suction pressure at port 12 to open or close the passage 18 between the compressor crankcase and discharge ports 14 and 16 by axially displacing the plunger 36. However, regardless of the plunger movement or refrigerant flow through the passage 18, the diaphragm 64 of sensor 60 is in continuous communication with the refrigerant discharge pressure at port 16 via the bores 40 and 42 of the stopper 26 and plunger 36, and the passage 56 between cavities 52 and 54. Integrating the sensor 60 into the control valve 10 reduces system cost, while providing an accurate and consistent measure of the compressor discharge pressure.

While the present invention has been described in reference to the illustrated control valve 10, it will be recognized that various modifications in addition to those mentioned above will occur to those skilled in the art. Accordingly, control valves incorporating such modifications may fall within the intended scope of this invention, which is defined by the appended claims.

What is claimed is:

1. A pneumatic control valve that selectively opens and closes a passage between compressor discharge and crankcase ports for purposes of controlling a compressor capacity, comprising:

a stopper biased against a seat in said passage, and having an axial bore;

a plunger having an axial bore that is aligned with the axial bore of said stopper, a first end that is maintained in engagement with said stopper so as to seal a compressor discharge fluid in the axial bores of said stopper and plunger, and a second end that is slidably disposed in a control valve cavity;

an annular bellows responsive to a compressor suction pressure and disposed radially about said plunger to effect axial displacement of said plunger and stopper for opening and closing said passage in response to said suction pressure; and a pressure sensor for sensing a pressure in said control valve cavity for producing a signal indicative of a pressure in said discharge port.

2. The pneumatic control valve of claim 1, wherein said stopper is slidably retained within said passage such that the axial bore of said stopper has a predetermined alignment.

3. The pneumatic control valve of claim 1, wherein the first end of said plunger is received within the axial bore of said stopper so as to mutually seal the compressor discharge fluid in the axial bores of said stopper and plunger.

4. The pneumatic control valve of claim 1, further comprising:

a sensor cavity in which at least a portion of said pressure sensor is retained; and an inter-cavity passage coupling said control valve cavity to said sensor cavity.

5. The pneumatic control valve of claim 4, further comprising:

an O-ring for sealing compressor discharge fluid in said cavity from a valve chamber outboard of said sensor.

6. The pneumatic control valve of claim 5, further comprising:

a seal for sealing said valve chamber from ambient pressure so that signal is indicative of an absolute pressure in said discharge port.

7. The pneumatic control valve of claim 4, wherein said control valve cavity, said sensor cavity and said inter-cavity passage are defined by a valve body piece retained in said valve.

8. The pneumatic control valve of claim 7, wherein a first end of said annular bellows is secured to said valve body piece, and a second end of said annular bellows is secured to said plunger.

9. The pneumatic control valve of claim 1, further comprising:

an electrical connector including terminals; and a flexible circuit electrically coupling said sensor to said connector terminals.

10. The pneumatic control valve of claim 9, wherein said flexible circuit supports circuit elements for conditioning said signal.

* * * * *